US006840590B2

(12) United States Patent
Hightower

(10) Patent No.: US 6,840,590 B2
(45) Date of Patent: Jan. 11, 2005

(54) ROLLOUT TRAY MOUNTING SYSTEM FOR CABINET

(75) Inventor: Robert C. Hightower, High Point, NC (US)

(73) Assignee: Tenn-Tex Plastics, Inc., Colfax, NC (US)

( * ) Notice: Subject to any disclaimer, the term of this patent is extended or adjusted under 35 U.S.C. 154(b) by 0 days.

(21) Appl. No.: 10/145,305

(22) Filed: May 13, 2002

(65) Prior Publication Data

US 2003/0209957 A1 Nov. 13, 2003

(51) Int. Cl.[7] ..... A47B 97/00
(52) U.S. Cl. ..... 312/249.4
(58) Field of Search ..... 312/249.4, 249.11, 312/330.1, 334.7, 334.4, 334.1

(56) References Cited

U.S. PATENT DOCUMENTS

| | | | | | |
|---|---|---|---|---|---|
| 3,119,643 | A | * | 1/1964 | Levi et al. | 312/334.4 |
| 4,681,381 | A | | 7/1987 | Sevey | |
| 5,039,181 | A | * | 8/1991 | Lautenschlager | 312/334.7 |
| 5,310,255 | A | * | 5/1994 | Ranallo | 312/334.5 |
| 5,372,417 | A | * | 12/1994 | Buie et al. | 312/245 |
| 5,457,867 | A | * | 10/1995 | Maberry et al. | 29/525 |
| 5,597,220 | A | * | 1/1997 | Domenig et al. | 312/334.4 |
| 5,746,490 | A | * | 5/1998 | Domenig | 312/334.5 |
| 5,823,648 | A | * | 10/1998 | Domenig | 312/334.5 |
| 5,833,337 | A | * | 11/1998 | Kofstad | 312/334.5 |
| 5,904,412 | A | * | 5/1999 | Lammens | 312/334.7 |
| 6,010,200 | A | * | 1/2000 | Hays | 312/334.7 |
| 6,070,957 | A | * | 6/2000 | Zachrai | 312/334.4 |
| 6,155,660 | A | * | 12/2000 | Nicolai | 312/223.1 |
| 6,270,281 | B1 | * | 8/2001 | Ruusuvuori | 403/11 |
| 6,273,534 | B1 | * | 8/2001 | Bueley et al. | 312/334.8 |
| 6,367,900 | B1 | * | 4/2002 | Woerner | 312/334.5 |
| 6,402,276 | B1 | * | 6/2002 | King | 312/334.7 |
| 6,422,399 | B1 | * | 7/2002 | Castillo et al. | 211/26 |
| 6,494,550 | B1 | * | 12/2002 | Chen et al. | 312/334.5 |

FOREIGN PATENT DOCUMENTS

| | | |
|---|---|---|
| EP | 0 791 313 A | 8/1997 |
| GB | 1 221 763 | 2/1971 |
| JP | 2001204565 | 5/2001 |

OTHER PUBLICATIONS

Iouis and company, Your single source for hardware, laminate, machinery & solid surfacing. "Adjustable Pantry Suspension Systems" (Vogt industries, inc.) p. F12.
Iouis and company, Your single source for hardware, laminate, machinery & solid surfacing. "Base Cabinet Pilaster System" (Houck Industries, Inc.) p F12.
Iouis and company, Your single source for hardware, laminate, machinery & solid surfacing. "Adjustable Base Cabinet Suspension Systems" (Vogt Industries, Inc.) p F12.
Iouis and company, Your single source for hardware, laminate, machinery & solid surfacing. "Rod Pilaster & Rail Kit" (Omega Industries, Inc.) p F13.
Iouis and company, Your single source for hardware, laminate, machinery & solid surfacing. "Wire Fence Rail System" Rev–A–Shelf, p F13.
Iouis and comapny, Your single source for hardware, laminate, machinery & solid surfacing. "Pilaster Mounting Bracket" (GRASS) p F13.
Partial European Search Report EP 03 01 0602 (2003).

* cited by examiner

*Primary Examiner*—Leslie A. Braun
*Assistant Examiner*—A. Joseph Wujciak, III
(74) *Attorney, Agent, or Firm*—Myers Bigel Sibley & Sajovec

(57) ABSTRACT

A mounting member for a cabinet tray or drawer includes: an elongate body portion having a front mounting surface and a longitudinal axis; and a plurality of substantially rectangular apertures located in the front mounting surface. The body portion is a unitary structure and being formed of a polymeric material. This mounting member can be employed in cabinets to mount trays or drawers.

57 Claims, 11 Drawing Sheets

ROLLOUT TRAY MOUNTING SYSTEM FOR CABINET

FIELD OF THE INVENTION

The present invention is directed generally to furniture, and more particularly to cabinets with sliding drawers and trays.

BACKGROUND OF THE INVENTION

Many cabinets, particularly those found in kitchens, include drawers for storing various items. Often, drawers are mounted to the cabinet with elongate slide members that are fixed to the side walls of the drawer. Each slide member slidably engages a second elongate slide member that is fixed to the walls of the cabinet (often one of the slide members includes a small wheel that facilitates sliding motion). Some of such cabinets include multiple drawers, which can be disposed in vertically stacked fashion, side-by-side fashion, or both. When drawers are located side-by-side, typically slide members are mounted to the rear wall of the cabinet and to an upright member at the front of the cabinet that the slide members of the cabinet can engage.

In some instances, it is desirable that the mounting height of the drawer be adjustable. This is particularly true when the cabinet includes one or more doors that cover the drawers and provide the visible front surface of the cabinet. The adjustability enables the user to select drawer heights that are convenient for the items to be stored. Adjustable height drawers are particularly popular when they take the form of flat trays, which often include a short perimeter rim to keep items from sliding off. Over the life of the cabinet, the user may choose to store different items on the tray, so the ability to adjust the mounting elevation of the tray can enable the cabinet to accommodate these different items.

One system for providing adjustable height drawers and trays includes short (typically about 6 inches in length) vertically disposed mounting members to which slide members are mounted. The vertical mounting members, which are L-shaped in cross-section, are typically mounted to the side walls of the cabinet via screws inserted into a recessed surface of the mounting member. The vertical mounting members include a series of round holes in their front surfaces into which round dowels projecting from the slide members can be inserted. Thus, the mounting height of the drawer is determined by which hole in the mounting members receives the round dowel.

One issue with this system is the attachment of the round dowel to the slide member. Because the dowel is typically relatively small (about 0.320 inch in diameter) and is round, it can be somewhat difficult to attach via screws to the slide member, as the dowel tends to spin undesirably during attachment. Also, the round dowels tend to slide out of the holes in the vertical mounting member during shipping and/or use of the cabinet. Moreover, the screws tend to "back-out" of the holes in the dowels, which can loosen the dowels or even cause them to become disconnected from the slide members.

Further, when the system discussed above is employed with a "face-frame" cabinet (i.e., one which includes a front wall frame attached to the front portions of the side walls of the cabinet), the vertical mounting members are typically mounted in the front corners of the cabinet. However, in many instances glue and/or staples used to attach the front wall frame to the side walls are present in the corners. Consequently, it may be difficult in some instances to position the mounting member flush against the corner. Also, the relatively short length of the mounting members ordinarily requires the installer to position the mounting members precisely so that the holes of facing mounting members are at substantially the same height; otherwise, the tray or drawer may not be level when mounted.

In addition, when used in a "frameless" cabinet (i.e., one in which there is no front frame piece), the mounting members are typically mounted in pre-formed holes in the side wall that are offset slightly from the front edge of the side wall. The hinges for the cabinet door are typically mounted to the inside surfaces of the side walls (often in the pre-formed holes). When the hinges are so mounted, the mounting members are mounted between the hinges and should extend far enough from the side wall into the interior of the cabinet to position the drawer slide member so that the drawer can slide in and out of the cabinet without interference from the hinges.

SUMMARY OF THE INVENTION

The present invention can provide a cabinet with drawers or trays that is easily assembled and can be retrofitted into many existing cabinets. As a first aspect, the present invention is directed to a cabinet adapted to receive a drawer that comprises: an enclosure comprising an upright rear wall and opposing upright side walls fixed at rear portions thereof to opposite ends of the rear wall; a pair of front elongate mounting members mounted generally upright in front portions of the side walls, each of the front mounting members having a mounting surface with a plurality of non-circular mounting apertures facing the other of the front mounting members; a pair of rear elongate mounting members mounted upright in rear portions of the side walls, each of the rear mounting members having a mounting surface with plurality of non-circular mounting apertures facing the other of the rear mounting members; a pair of slide members, each slide member extending between a respective rear mounting member and a respective front mounting member; and two pairs of mounting dowels, with one mounting dowel of each pair connecting a rear end portion of a slide member to a respective rear mounting member, and with the other mounting dowel of each pair connecting a front end portion of the slide member to a respective front mounting member. Each of the mounting dowels has a body that is non-circular in cross-section and that is sized and configured to be received in one of the plurality of apertures in a respective front or rear mounting member. The apertures for receiving the dowels are selected such that each slide member is generally horizontally disposed, and such that each slide member of the pair of slide members is mounted at approximately the same height as the other slide member of the pair. In this configuration, the height of a drawer or tray can be easily adjusted. Also, the configuration of the mounting system of the drawer or tray can be easily assembled in a new cabinet or retrofitted into an existing cabinet, whether that cabinet has one or multiple access openings.

In another embodiment, the apertures of the mounting members described above may be of any shape, as may be the cross-sections of the mounting dowels described above, and the mounting dowels may include a tapered portion and a hook portion that extends in a direction that is generally perpendicular to the longitudinal direction of the mounting dowel.

In either of these embodiments, the front and rear mounting members are preferably of substantially identical configuration, as this can reduce manufacturing and shipping costs as well as facilitate assembly. It is also preferred that the front and rear mounting members have cutaway areas that can enable them to be mounted flush in the front and rear corners of the enclosure without interference from glue, staples or the like that may be present in the corners from assembly.

In an additional embodiment, the present invention is directed to a mounting dowel adapted to mount a drawer within a cabinet. Such a mounting dowel comprises: a body (preferably generally rectangular in cross-section) having a tapered portion at a first end thereof, the body having an aperture extending therewithin from a second end of the body opposite the first end; and a hook portion attached at the end of the body portion and extending generally perpendicular to a longitudinal axis of the body defined by the first and second ends. The body and hook portion are integrally formed as a unitary member. In this configuration, the dowel can be easily handled as it is attached to a slide member on which a drawer or tray is mounted, and can provide stability to the mounted drawer to prevent its sliding out of place during use. As a further embodiment, the present invention is directed to an assembly comprising a slide member for a sliding tray and a mounting dowel. The mounting dowel is of non-circular (preferably generally rectangular) cross-section. Any of the mounting dowel embodiments may include raised ridges or other texture on the surface thereof that is adapted to abut the slide member of a drawer assembly.

The present invention is further directed to a mounting member for a cabinet tray or drawer. The mounting member comprises: an elongate body portion having a front mounting surface and a longitudinal axis; and a plurality of non-circular apertures located in the front mounting surface. The body portion is a unitary structure and is formed of a polymeric material. As noted above, such a mounting member can provide significant performance advantages, and it also has the capacity for use in all areas of the cabinet, which can eliminate the need for separate "right-hand" and "left-hand" pieces as well as for "front" and "back" pieces. In another embodiment, the mounting member may be formed of any material and include at least one side wall connected to the mounting surface and a spacing ear extending from one of the side walls. In an additional embodiment, the body portion of the mounting member may be generally U-shaped and include a plurality of ribs extending from the front mounting surface and lining at least some of the apertures.

As a fourth aspect, the present invention is directed to a screw for fastening two members together, one of the members having a threaded receiving aperture, comprising: a head including recess adapted to receive a driving tool; and a threaded shank, wherein a portion of the shank is coated with a friction-imparting coating that increases friction between the shank and the threaded receiving aperture of the member. The presence of the friction-imparting coating can increase the tendency of the shank to remain stationary relative to the threaded receiving aperture.

DETAILED DESCRIPTION OF THE INVENTION

Figure 1:
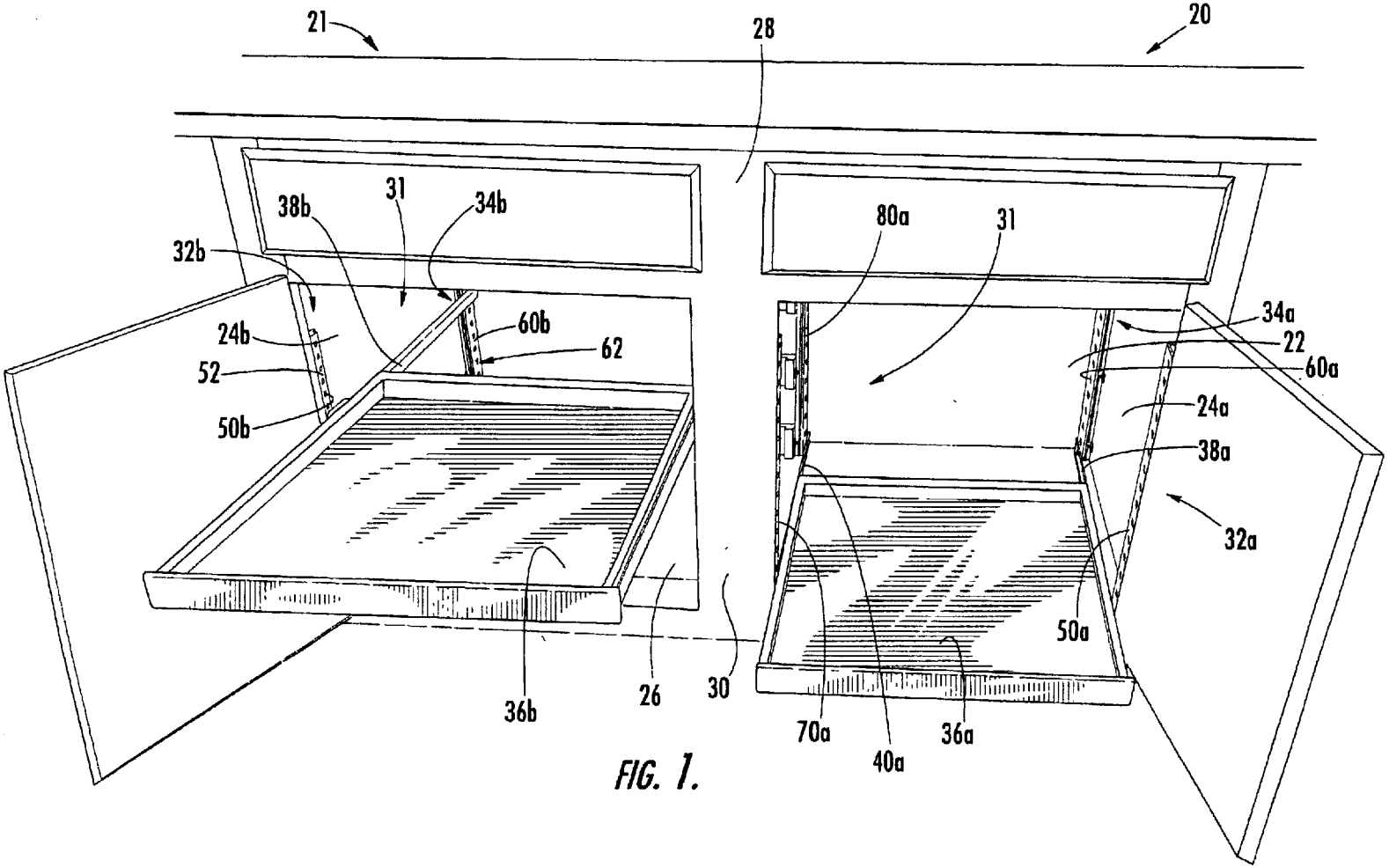
FIG. 1 is front perspective view of a cabinet of the present invention.
Figure 2:
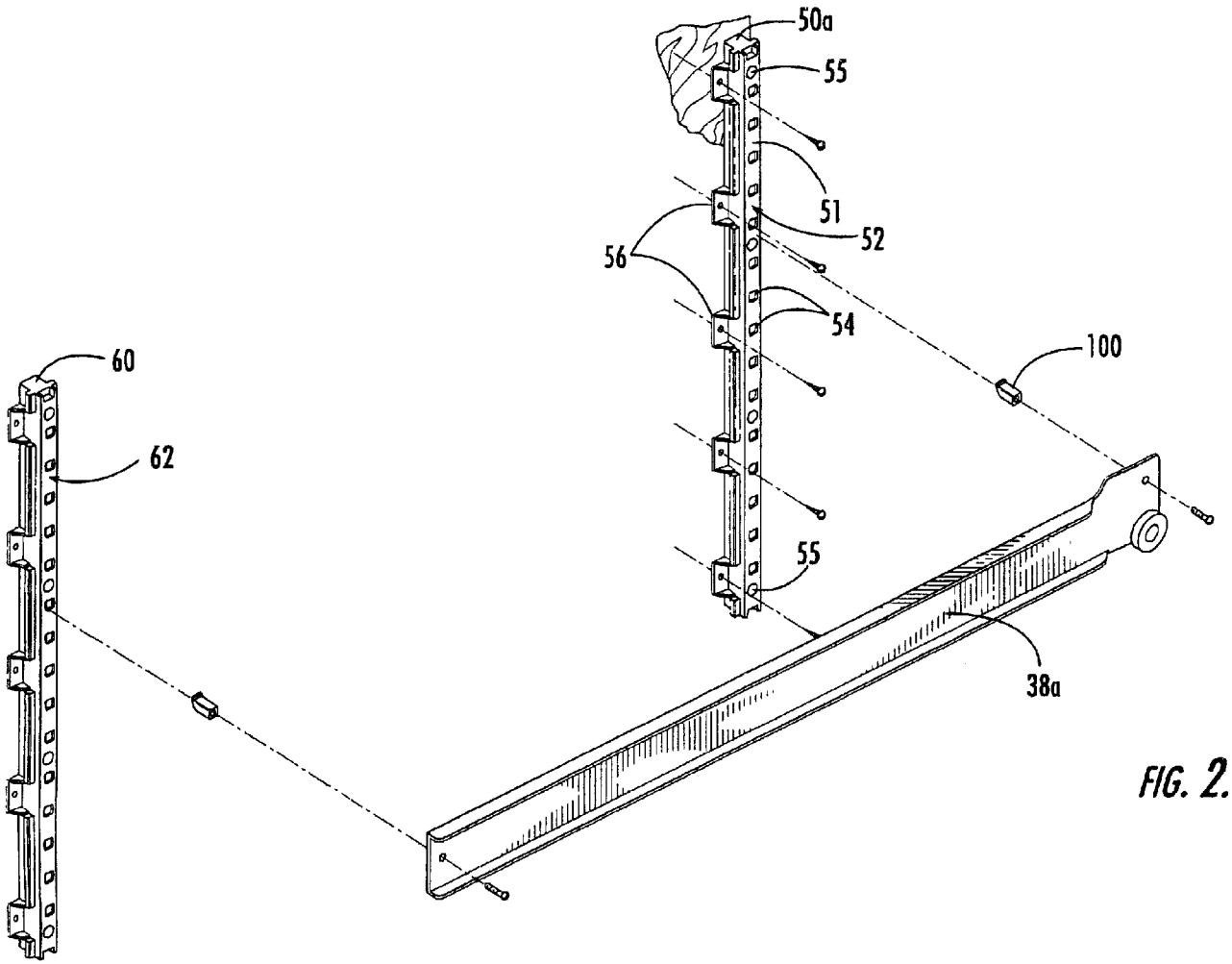
FIG. 2 is an exploded perspective view of front and rear mounting members, a slide member and two mounting dowels of the cabinet of FIG. 1.
Figure 3:
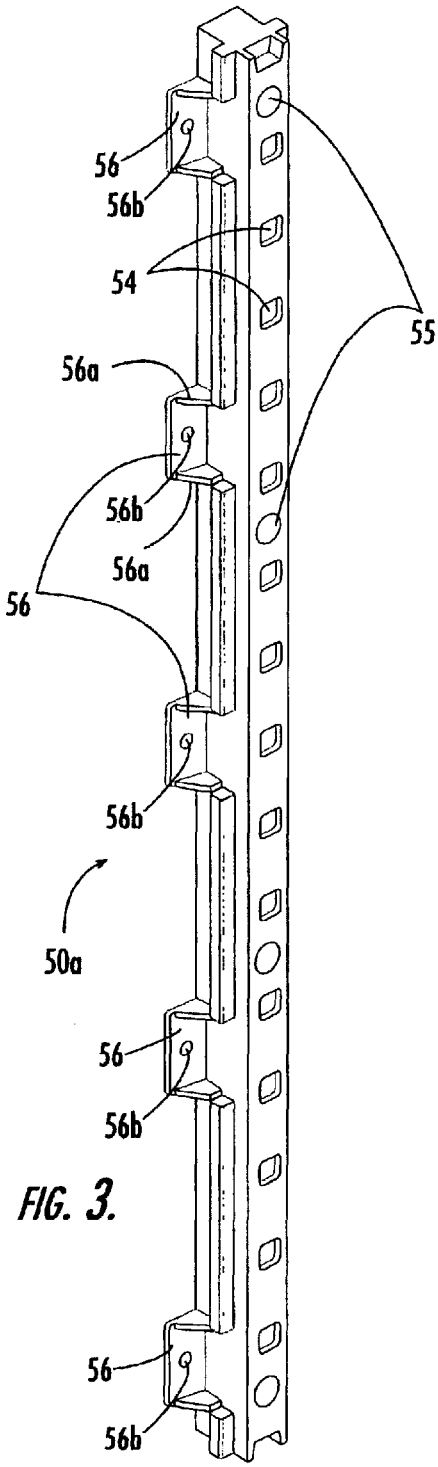
FIG. 3 is a perspective view of a mounting member of the cabinet of FIG. 1.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Referring now to the figures, a face-frame cabinet, designated broadly at 20, is illustrated in FIG. 1. The cabinet 20 includes an enclosure 21 having a rear wall 22, side walls 24*a*, 24*b* mounted perpendicular thereto, a floor 26 generally that is horizontally disposed, and a front wall 28 mounted generally parallel to the rear wall 22. The front wall 28 includes a vertical center member 30 that defines two access openings 31 on either side. Typically the enclosure 21 is formed of wood, but other materials known to be suitable for cabinets may also be employed.

Those skilled in this art will recognize that the configuration of the enclosure 21 can vary and still be encompassed by the present invention. For example, the enclosure 21 may lack a center member 30, with the result that the cabinet 20 has only one access opening, or it may have more than one vertical member, with the result that the cabinet 20 has more than two access openings.

Figure 9:
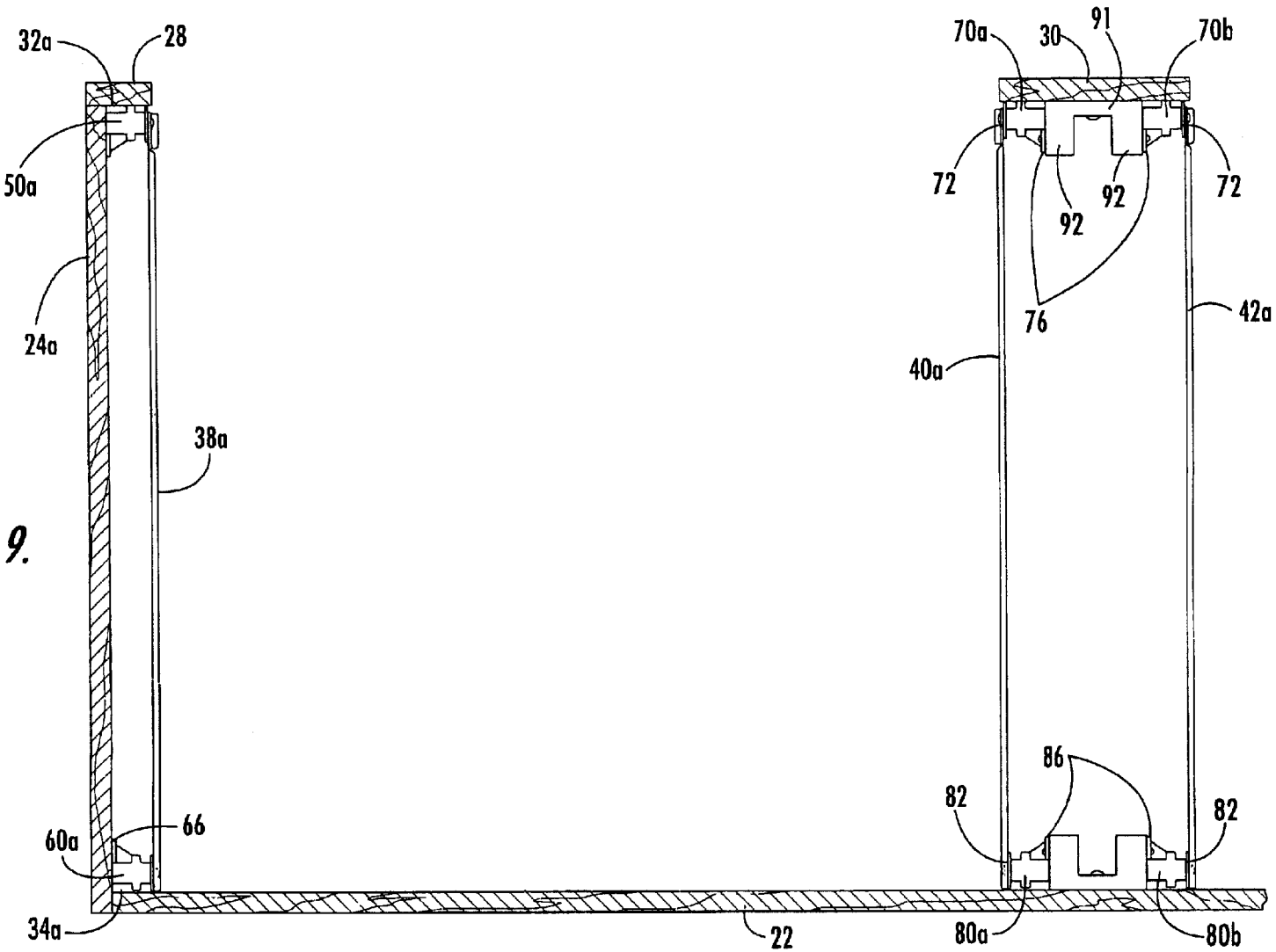
FIG. 9 is a top section view of the cabinet of FIG. 1 showing the mounting configuration of the inner slide members.

The respective intersections between the rear wall 22 and the side wall 24*a*, 24*b* form rear corners (one is shown at 34*a* in FIG. 9). Similarly, the respective joints between the front wall 28 and the side walls 24*a*, 24*b* form front corners (one is shown at 32*a* in FIG. 9).

Referring again to FIG. 1, two trays 36*a*, 36*b* are slidably mounted within the enclosure 21. Each tray 36*a*, 36*b* is attached to elongate engagement members 42 (one of which is shown in FIG. 1) that extend generally horizontally along the side edges of the trays 36*a*, 36*b*. Those skilled in this art will recognize that the trays 36*a*, 36*b* may be replaced by drawers, and that different numbers of trays and/or drawers that that described herein may be employed with the present invention.

Referring again to FIG. 1 and also to FIG. 9, within the enclosure 21, slide members 38*a*, 38*b* are horizontally disposed between respective front corners 32*a*, 32*b* and respective rear corners 34*a*, 34*b*. In addition, a pair of inner slide members 40*a*, 40*b* are mounted between the center member 30 and a central portion of the rear wall 22. The slide members 38*a*, 38*b* and the inner slide members 40*a*, 40*b* engage the engagement members 42 of the trays 36*a*, 36*b* and enable the trays 36*a*, 36*b* to slide relative to the remainder of the cabinet 20. Any configuration of slide members and engagement members that enable sliding movement of the trays 36*a*, 36*b* and the enclosure 21 may be employed with the present invention.

Referring to FIGS. 1, 2, 9 and 10, the slide members 38*a*, 38*b* and the inner slide members 40*a*, 40*b* are mounted to the cabinet 20 via vertically disposed mounting members. Front mounting members 50*a*, 50*b* are mounted in respective front corners 32*a*. Rear mounting members 60*a*, 60*b* are mounted in respective rear corners 34*a*. Front inner mounting members 70*a*, 70*b* are mounted to the rear surface of the center member 30. Rear inner mounting members 80*a*, 80*b* are mounted to a central portion of the rear wall 22. In the illustrated embodiment, the structure of each of the front mounting members 50*a*, 50*b*, the rear mounting members 60*a*, 60*b*, the front inner mounting members 70*a*, 70*b*, and the rear inner mounting members 80*a*, 80*b* is substantially identical, with only the manner by which these components are mounted and their orientation within the cabinet 20 differing. As such, only the front mounting member 50*a* will be described in detail herein, with the understanding that this discussion is equally applicable to the other mounting members. Differences in mounting location and orientation for the other mounting members will be pointed out below.

Turning now to FIGS. 2–4 and 5B, the front mounting member 50*a* has a body 51 that is elongate and has a generally U-shaped cross-section. The base of the "U" provides a mounting surface 52 that includes a plurality of apertures 54 (illustrated herein as being generally rectangular) substantially equally spaced along the longitudinal axis A1 of the body 51 (the spacing is typically between about 0.75 and 2 inches). Also, four countersunk apertures 55 are present in the mounting surface 52. Opposed side walls 53*a*, 53*b* extend generally perpendicularly from the mounting surface 52 and parallel to each other to form the legs of the "U" of the body 51.

Figure 4:
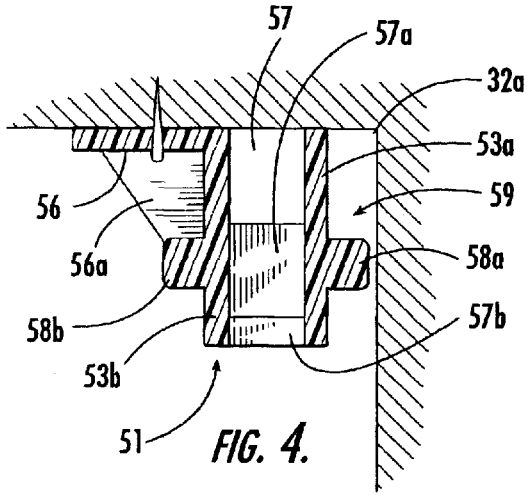
FIG. 4 is a top section view of the mounting member of FIG. 3 mounted in a front corner of the cabinet of FIG. 1.
Figure 5A:
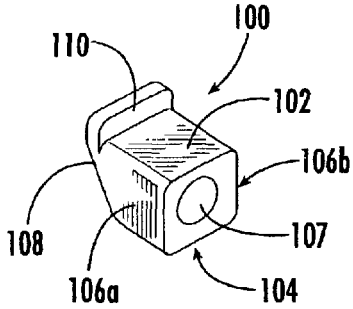
FIG. 5A is a perspective view of a mounting dowel of the cabinet of FIG. 1.
Figure 5B:
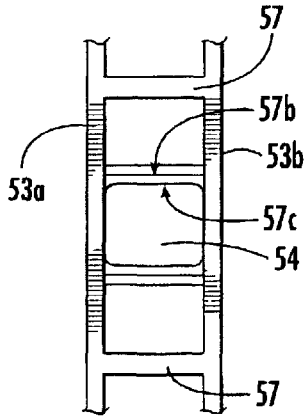
FIG. 5B is an enlarged rear partial view of the mounting member of FIG. 3.
Figure 6:
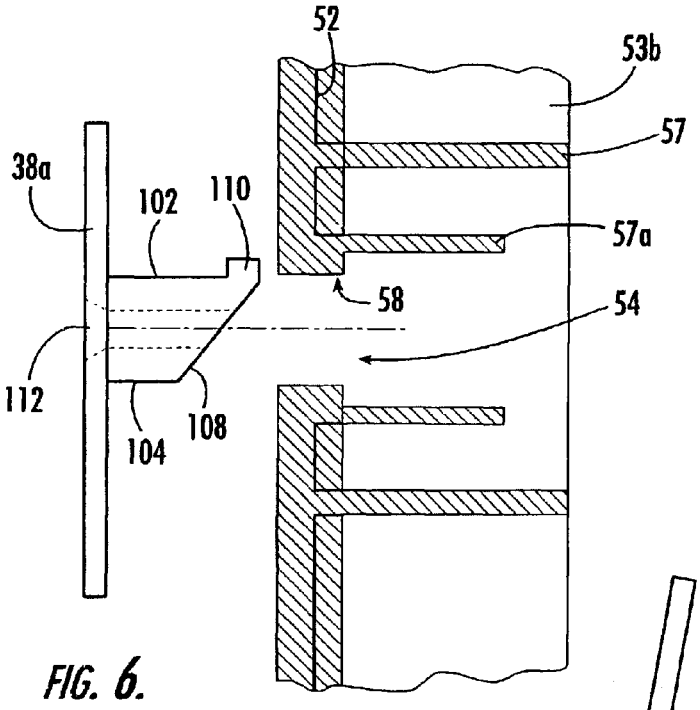
FIG. 6 is an enlarged partial front view of the slide member and mounting dowel of the cabinet of FIG. 1 prior to insertion into a mounting member.
Figure 7:
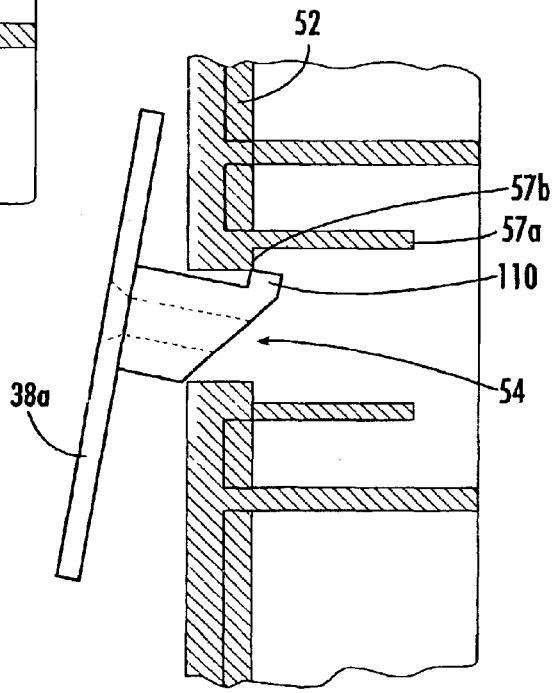
FIG. 7 is an enlarged partial front section view of the slide member, mounting dowel and mounting member of FIG. 6 with the dowel partially inserted in the mounting member.
Figure 8:
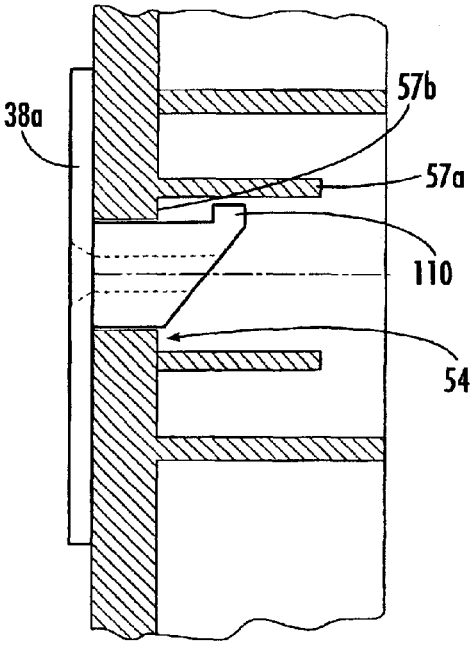
FIG. 8 is an enlarged partial front section view of the slide member, mounting dowel and mounting member of FIG. 6 with the dowel fully inserted in the mounting member.

Referring now to FIGS. 4 and 5B, the front mounting member 50*a* also includes a plurality of horizontally disposed ribs attached to and extending away from the mounting surface 52. Support ribs 57 are positioned between pairs of adjacent apertures 54 and extend the full width of the side walls 53*a*, 53*b*. Engagement ribs 57*a* are positioned directly above and below the apertures 54 and extend away from the mounting surface 52 for approximately two-thirds of the width of the side walls 53*a*, 53*b*. Illustratively and preferably, each engagement rib 57*a* has a stepped surface 57*b* that defines the upper or lower perimeter portion (depending on its location) of the adjacent aperture 54.

A number of mounting tabs 56 that include apertures 56*b* extend from the side wall 53*a*. The mounting tabs 56 are reinforced by gussets 56*a* that extend between the mounting tabs 56 and the side wall 53*a*. Also, spacing ears 58*a*, 58*b* located on each side wall 53*a*, 53*b* project outwardly a short distance in a direction parallel to the mounting surface 52*a*. As a result, on the side of the front mounting member 50*a* opposite the mounting tabs 56 (i.e., on side wall 53*b*), a cut-away region 59 is formed.

Figure 20:
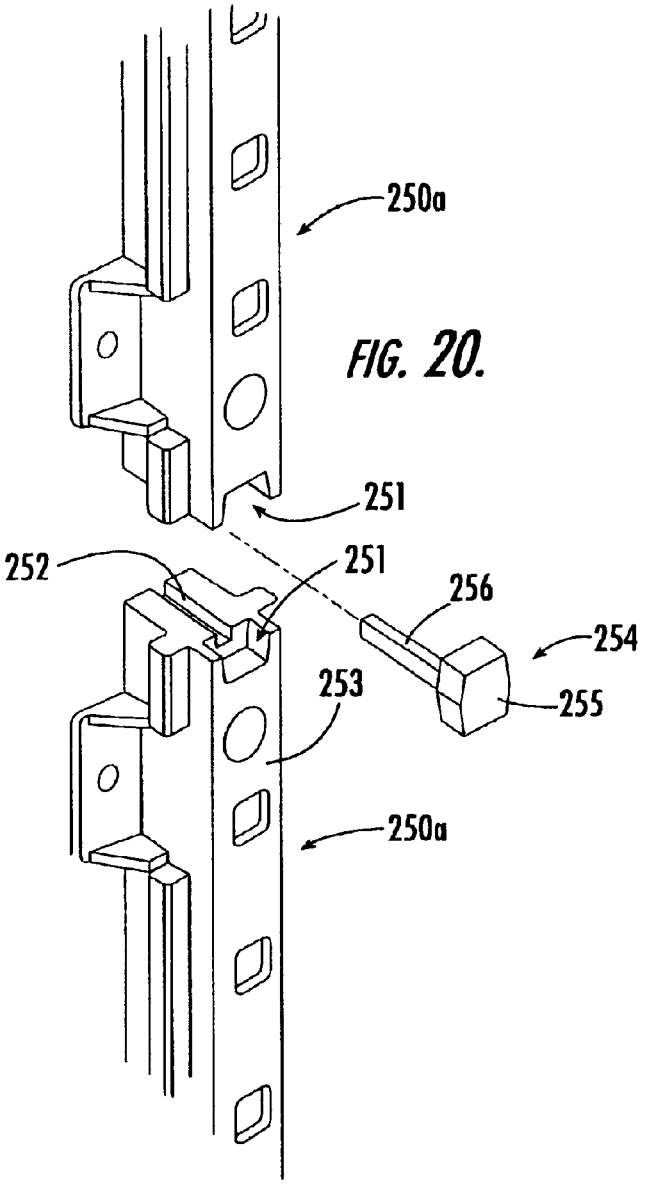
FIG. 20 is an enlarged partial perspective view of a pair of mounting members being interconnected according to embodiments of the present invention.

Typically the mounting member 50*a* is formed of a polymeric material (such as ABS), but it can be formed of any material known to be suitable for forming into the desired shape. The mounting member 50*a* may be of any length, but is typically at least 12 inches in length, and in some embodiments at least 24 inches in length. Notably, the mounting member 50*a* may include structures at either end that enable two or more mounting members 50*a* to be stacked vertically. For example, an additional variation of a mounting member (designated at 250*a*) illustrated in FIG. 20 include a recess 251 in the front mounting surface 253 at each end, with a further slot 252 extending longitudinally within the recess 251. An alignment pin 254 with a head 255 and a shaft 256 is employed to align the mounting members 250*a*. The head 255 is shaped to conform to a second recess formed by the combination of the recesses 251, and the shaft 256 is shaped to fit within the combined slots 252. Thus, in the event a cabinet requires that more that one mounting member 250*a* be used at each mounting location, multiple mounting members 250*a* can be stacked upon one another and aligned longitudinally with the pin 254.

Referring now to FIG. 4, the front mounting member 50*a* is mounted in the front corner 32*a* of the enclosure 21. The front mounting member 50*a* is mounted such that the mounting surface 52 faces the opposite side wall 24*b*, the mounting tabs 56 extend toward the rear wall 22, and the cutaway area 59 encloses the front corner 32*a*. The front mounting member 50*a* is attached to the side wall 24*a* via screws, staples, or other appropriate fasteners (staples being preferred) that are inserted through the mounting tabs 56. Alternatively, the mounting member may 50*a* be mounted to the cabinet side wall 24*a* via screws inserted through the countersunk apertures 55. Notably, the presence of the cutaway area 59 enables the front mounting member 50*a* to be mounted in the front corner 32*a* flush with the rear surface of the front wall 28 and the inner surface of the side wall 24*a* without interference from glue, nails, staples, and the like that may be present in the front corner 32*a*.

Referring again to FIGS. 1 and 9, the mounting orientation of the remaining mounting numbers is illustrated. The front mounting member 50*b* is mounted in the front corner 32*b* with its mounting surface 50 facing the side wall 24*a* and its mounting tabs 56 extending toward the rear wall 22. The rear mounting member 60*a* is mounted in the rear corner 34*a* with its mounting surface 62 facing the side wall 24*b* and its mounting tabs 66 extending toward the front wall 28. The rear mounting member 60*b* is mounted in the rear corner 34*b* with its mounting surface 62 facing the side wall 24*a* and its mounting tabs 66 also extending toward the front wall 28.

Figure 10:
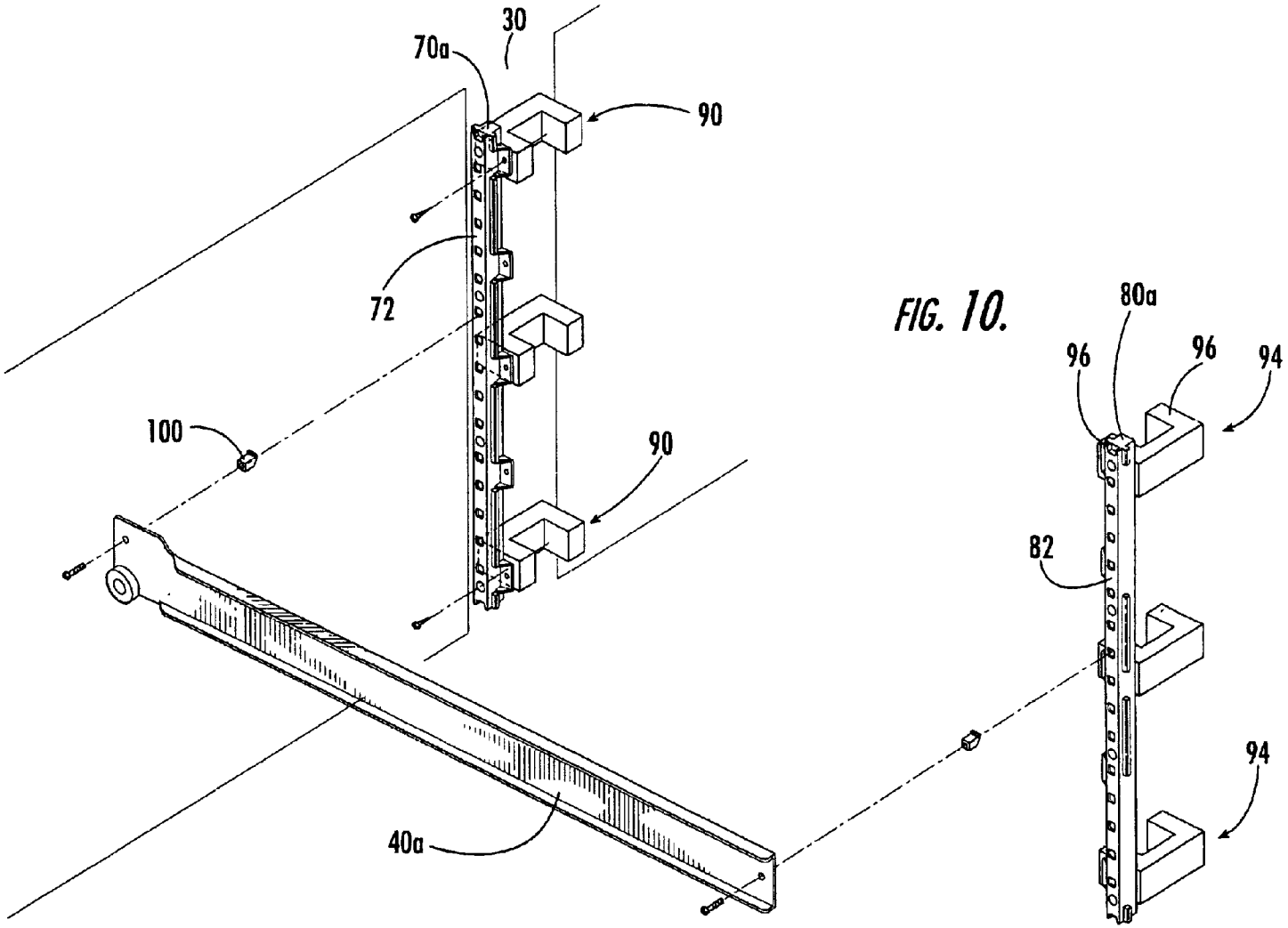
FIG. 10 is a rear exploded perspective view showing the mounting of an inner slide member into two inner mounting members in the cabinet of FIG. 1.

Referring now to FIGS. 9 and 10, the front inner mounting members 70*a*, 70*b* and the rear inner mounting members 80*a*, 80*b* are mounted to, respectively, the center member 30 of the front wall 28 and a central portion of the rear wall 22 through three front connectors 90 and three rear connectors 94. Each front connector 90 includes a body 91 and a pair of mounting flanges 92. The body 91 is mounted flush against the rear surface of the center member 30. Similarly, the three rear connectors 94 are mounted to a central portion of the rear wall 22 with their mounting flanges 96 extending forwardly.

The front inner mounting members 70*a*, 70*b* are mounted to the mounting flanges 92 of the front connector 90. More specifically, the mounting tabs 76 of the front inner mounting members 70*a*, 70*b* overlie the mounting flanges 92 and are attached thereto via screws, staples or the like. The front inner mounting member number 70*a* is mounted such that its mounting surface 72 faces the side wall 24*a* and its mounting tabs 76 face rearwardly. The front inner mounting member 70*b* is mounted such that its mounting surface 72 faces the side wall 24*b* and its mounting tabs 76 face rearwardly. The rear inner mounting member 80*a* is mounted to the rear connector 94 such that its mounting surface 82 faces the side wall 24*a* and its mounting tabs 86 face forwardly. Similarly, the rear inner mounting member 80*b* is mounted to the rear connector 94 such that its mounting surface 82 faces the side wall 24*b* and its mounting tabs 86 face forwardly.

Those skilled in this art will recognize that other configurations for the mounting members described above may be suitable for use with the present invention. For example, mounting members having more or fewer apertures may be used. Also, the mounting members need not be identical to each other, although utilizing identical mounting members (such as those illustrated herein) may be preferred for simplicity and cost of manufacture, packaging and assembly. Further, if inner front and rear mounting members are included, they may be attached to a vertical member through structures other than the connectors described herein. Moreover, although the inclusion of a cutaway portion 59 is preferred, it may be omitted in some embodiments.

Turning now to FIGS. 5A and 6–8, the mounting dowel 100 illustrated therein has a body 101 of generally rectangular cross-section defined by a top surface 102, a bottom surface 104 and opposing side surfaces 106*a*, 106*b*. An aperture 107 extends through the body 101 for receipt of a screw 112. At one end, the mounting dowel 100 has a tapered portion 108 that terminates in a hook 110 that extends upwardly from the tapered portion 108. The dowel 100 is preferably formed of a metallic material, such as zinc, and has a length of between about 0.250 and 1.50 inch.

Those skilled in this art will recognize that other configurations for the dowel 100 may also be suitable for use with the present invention. For example, the body 101 may have a square cross-section (as used herein, the term "rectangular" in describing cross-sections is intended to encompass square cross-sections as well as non-square rectangular cross-sections), or any number of other non-circular cross-sections (such as triangular, pentagonal, trapezoidal, oblong, or the like). Of course, the shape of the apertures of the mounting member 50*a* should substantially match that of the cross-section of the dowel. Also, some embodiments of the present invention may lack the tapered portion 108 or the hook portion 110. In addition, a dowel of circular cross-section may be used, but should have a hook portion. Further, the hook portion may take different configurations, but should project away from the body in a direction that is generally perpedicular to the longitudinal axis of the body.

To assemble the cabinet 20, first the walls 22, 24*a*, 24*b*, 28 and floor 26 of the enclosure 21 are attached. The front and rear mounting members 50*a*, 50*b*, 60*a*, 60*b* are then inserted into their respective front and rear corners 32*a*, 32*b*, 34*a*, 34*b* and attached to the side walls 24*a*, 24*b* with screws, staples, or like fasteners (preferably screws) inserted through the mounting tabs 56. The front and rear connectors 90, 94 are then attached to, respectively, the rear surface of the center member 30 and the central portion of the rear wall 22. The front and rear inner mounting members 70*a*, 70*b*, 80*a*, 80*b* are then mounted to the flanges 92, 96 of the front and rear connectors 90, 94. The universality of the mounting members can facilitate these steps.

The mounting dowels 100 are then attached to the slide members 38*a*, 38*b* and to the inner slide members 40*a*, 40*b* with screws inserted through the apertures 107 in the dowels 100. The square or rectangular cross-section of the dowels 100 enables the assembler to more easily grasp the dowels 100 as the screws are being inserted. The slide members 38*a*, 38*b* can then be mounted on the mounting members 50*a*, 50*b*, 60*a*, 60*b* by inserting the dowels 100 into a selected aperture 54 in the mounting surface 52 of each mounting member (see FIGS. 6–8). Alternatively, the dowel 100 can be positioned in the desired aperture 54 prior to its attachment to the slide member 38*a*, 38*b*, with the aperture 54 serving to grasp the dowel 100 during the insertion of the screw into aperture 107.

Once the dowel 100 is in place within an aperture 54, the hook portion 110 extends upwardly beyond the elevation of the stepped surface 57*b* of the engagement rib 57*a* and contacts the remainder of the engagement rib 57*a*. The presence of the hook portion 110 and the stepped surface 57*b* assist in maintaining the slide members 38*a*, 38*b* in place, as movement of the dowel 100 out of the aperture 54 is prevented by the stepped surface 57*b*.

After the slide members 38*a*, 38*b* are mounted on the mounting members 50*a*, 50*b*, 60*a*, 60*b*, the inner slide members 40*a*, 40*b* can then be similarly mounted in selected apertures in the front and rear inner mounting members 70*a*, 70*b*, 80*a*, 80*b*. The trays 36*a*, 36*b* can then be mounted in the enclosure 21 by engaging the engagement members 42 with the slide members 38*a*, 38*b* and the inner slide members 40*a*, 40*b* to produce the cabinet 20 of FIG. 1.

Figure 11:
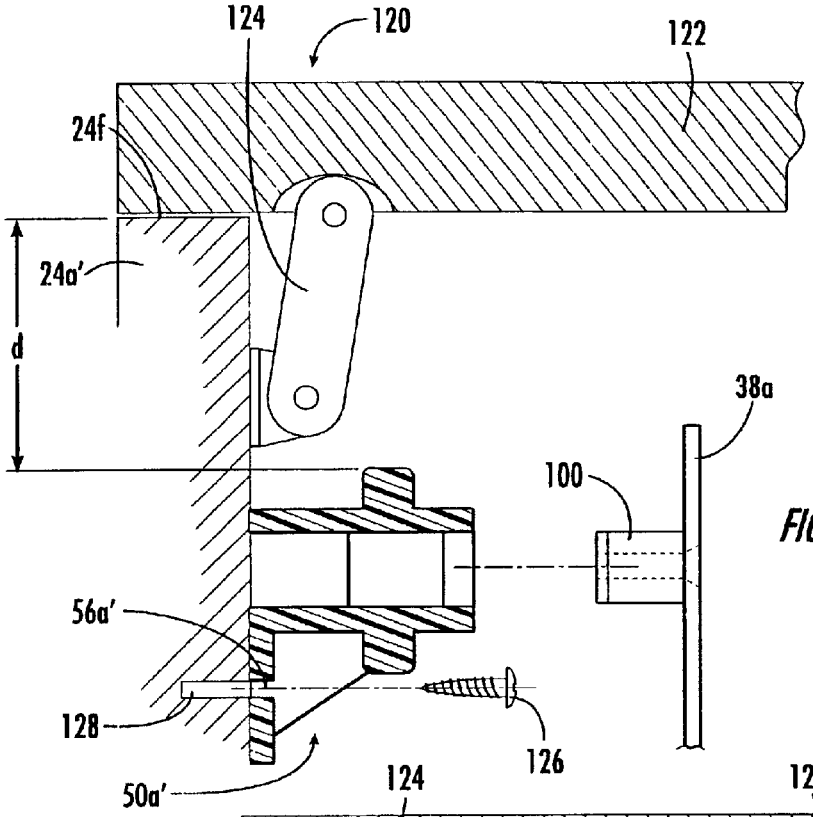
FIG. 11 is a top, exploded section view of a "frameless" cabinet according to the present invention illustrating the position of a mounting member and slide member relative to the front door hinge, with the mounting member being mounted in the cabinet side wall via a screw inserted into a mounting tab.
Figure 12:
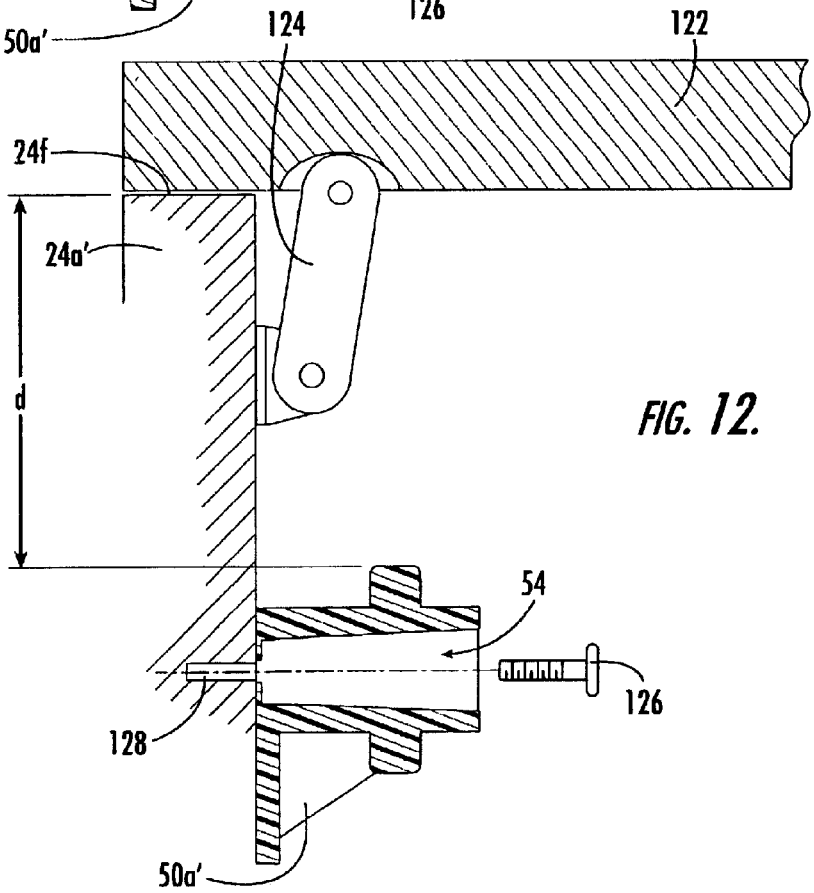
FIG. 12 is a top, exploded section view of the frameless cabinet of FIG. 11 illustrating the mounting of the mounting member to a side wall of the cabinet via insertion of a screw through apertures in the mounting member.

Another embodiment of the present invention is illustrated in FIGS. 11–12, wherein a portion of a frameless cabinet, designated broadly at 120, is shown. The cabinet includes a floor, a rear wall (both of which are absent from FIGS. 11 and 12) and opposed side walls (one of which, designated at 24*a*', is shown in FIGS. 11 and 12). Rather than having a front wall like the cabinet embodiment illustrated in FIGS. 1–10, the cabinet 120 lacks a front wall (hence, the term "frameless" cabinet), and instead includes a door 122 attached to the side wall 24*a*' through a hinge 124. Because of the presence of the hinge 124, a mounting member 50' cannot be positioned in the forwardmost portion of the cabinet 120, but instead is positioned a distance d away from the front edge 24*f* of the side wall 24*a*'. As with the mounting member 50*a* described above, the mounting member 50*a*' may be attached to the side wall 24*a*' via staples, but many frameless cabinets include predrilled holes (such as that shown at 128, which are often included in such cabinets for the mounting of stationary shelves) in which one or more screws 126 may be inserted. The screws 126 may be inserted through the apertures 56*a*' (see FIG. 11) or through the countersunk apertures 55' (see FIG. 12) and into the pre-drilled holes 128. Thus, the same mounting member configuration can be employed for either face-frame or frameless cabinets, and can take advantage of the pre-drilled holes often present in frameless cabinets.

Figure 13:
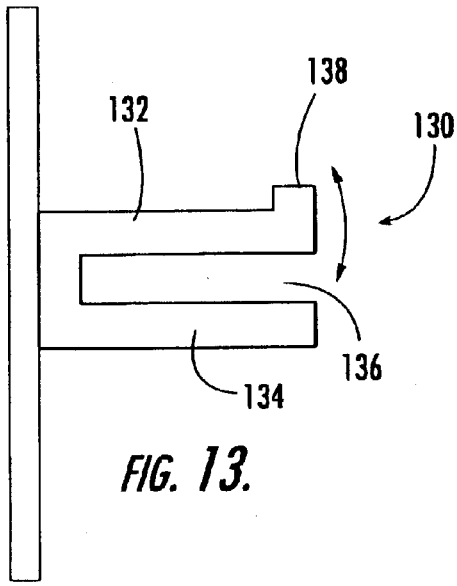
FIG. 13 is a front view of an alternative mounting dowel of the present invention.

Referring now to FIG. 13, another embodiment of a mounting dowel, designated at 130, is illustrated. The mounting dowel 130 includes an upper finger 132 upon which a hook portion 138 is located, and further includes a lower finger 134. The upper and lower fingers 132, 134 define an open slot 136. Like the dowel 100, the dowel 100 has a generally rectangular cross-section. The slotted configuration enables the upper finger 132 to deflect toward and away from the lower finger 134. As such, when the mounting dowel 130 is inserted into an aperture 54 of a mounting member 50, the upper finger 132 can deflect toward the lower finger 134 to facilitate entry of the dowel 130 into the aperture 54. Once the hook portion 138 has advanced sufficiently to clear the stepped surface 57*b*, the upper finger 132 is free to recover toward its original configuration (i.e., to deflect away from the lower finger 134). A dowel 130 having this configuration may facilitate insertion by eliminating or reducing the degree of tilt necessary for insertion (compare, for example, FIG. 7) and improve retention of the dowel 130 within the aperture 54.

Figure 14:
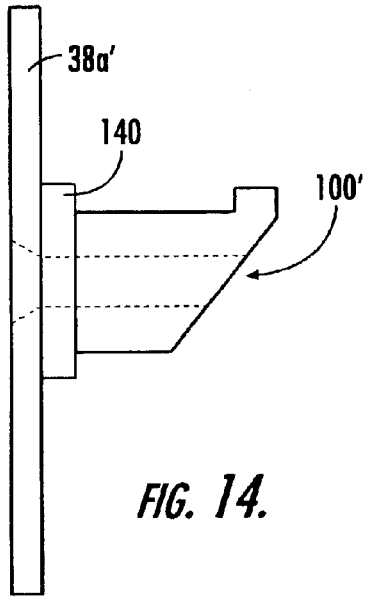
FIG. 14 is a front view of an alternative mounting dowel and slide member of the present invention with a spacer for varying the distance between the dowel hook and the slide member.

Referring now to FIG. 14, another embodiment of a mounting dowel and slide member, designated broadly at 100' and 38*a*', respectively, is illustrated therein. The mounting dowel 100' and the slide member 38*a*' are each of the same configuration as those illustrated in FIGS. 1–10; however, the mounting dowel 100' is separated from the slide member 38*a*' by a spacer 140. The spacer 140 serves locate the slide member 38*a*' farther from the side wall 24*a* than would be the case absent the spacer 140. This additional distance may be necessary and/or desirable if the front wall of the cabinet extends so far inwardly that the mounting of the slide member illustrated in FIGS. 1–10 positions the tray such that the front wall would block the tray from sliding forwardly beyond the front wall, or if the hinge of a frameless or face frame cabinet is positioned farther inwardly than would allow for unimpeded sliding of the tray. Typically, the spacer 140 is between about 0.090 and 0.250 inch in thickness.

Figure 21:
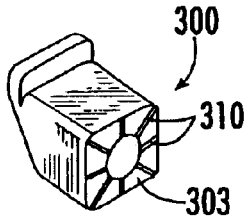
FIG. 21 is a perspective view of a mounting dowel according to embodiments of the present invention.

Another embodiment of a mounting dowel, designated broadly at 300, is illustrated in FIG. 21. The mounting dowel 300 includes raised ridges 310 in the surface 303 that abuts a slide member. The ridges 310 extend radially and protrude from the surface 303 between about 0.005 and 0.020 inches. When the dowel 300 is mounted to the slide member via a screw or other fastener, the ridges 303 grip the surface of the slide member to prevent unwanted twisting or spinning of the dowel 300. Other textured gripping structures, such as knurls, a roughened surface, or the like, may also be used with this embodiment of the invention.

Figure 15:
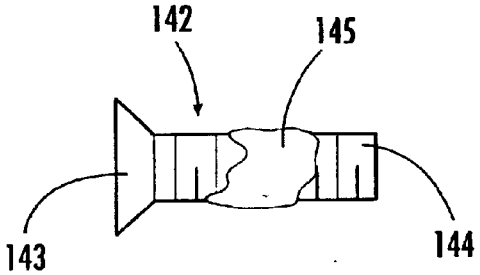
FIG. 15 is a top view of a threaded fastener of the present invention.
Figure 16:
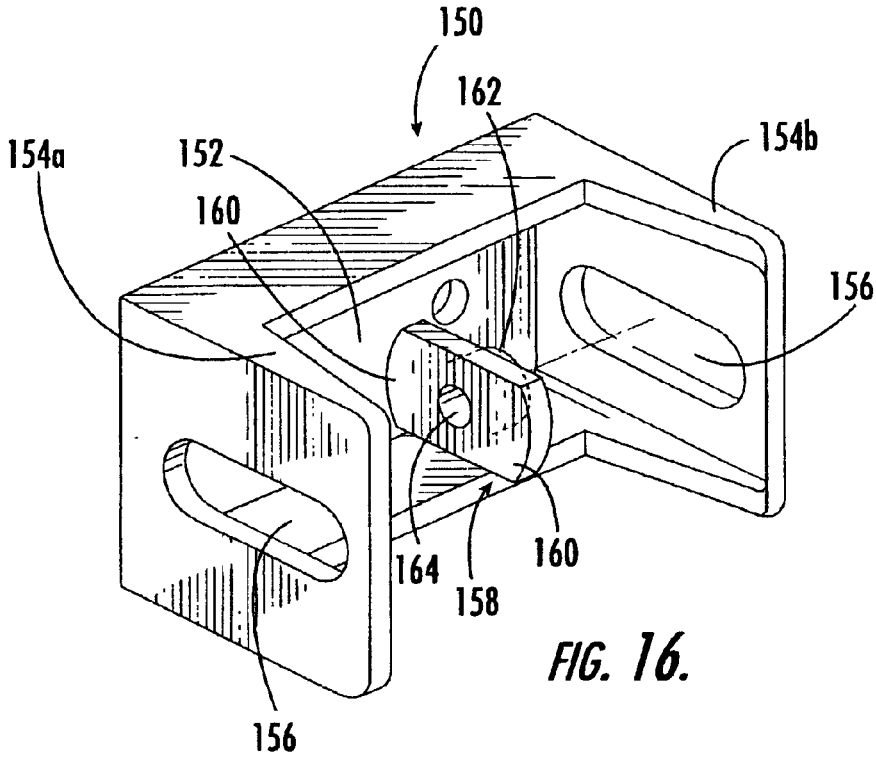
FIG. 16 is an enlarged perspective view of an alternative mounting connector of the present invention.
Figure 17:
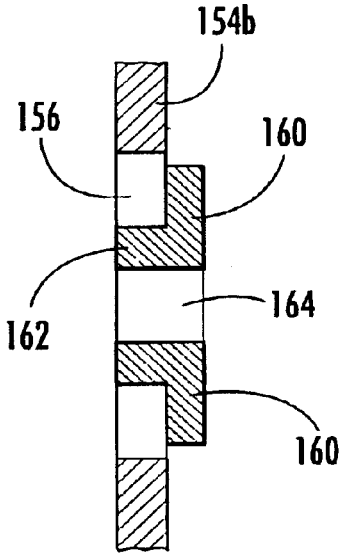
FIG. 17 is a top section view of the connector of FIG. 16.
Figure 18:
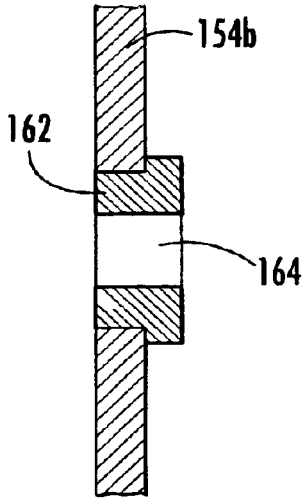
FIG. 18 is a front section view of the connector of FIG. 16.
Figure 19:
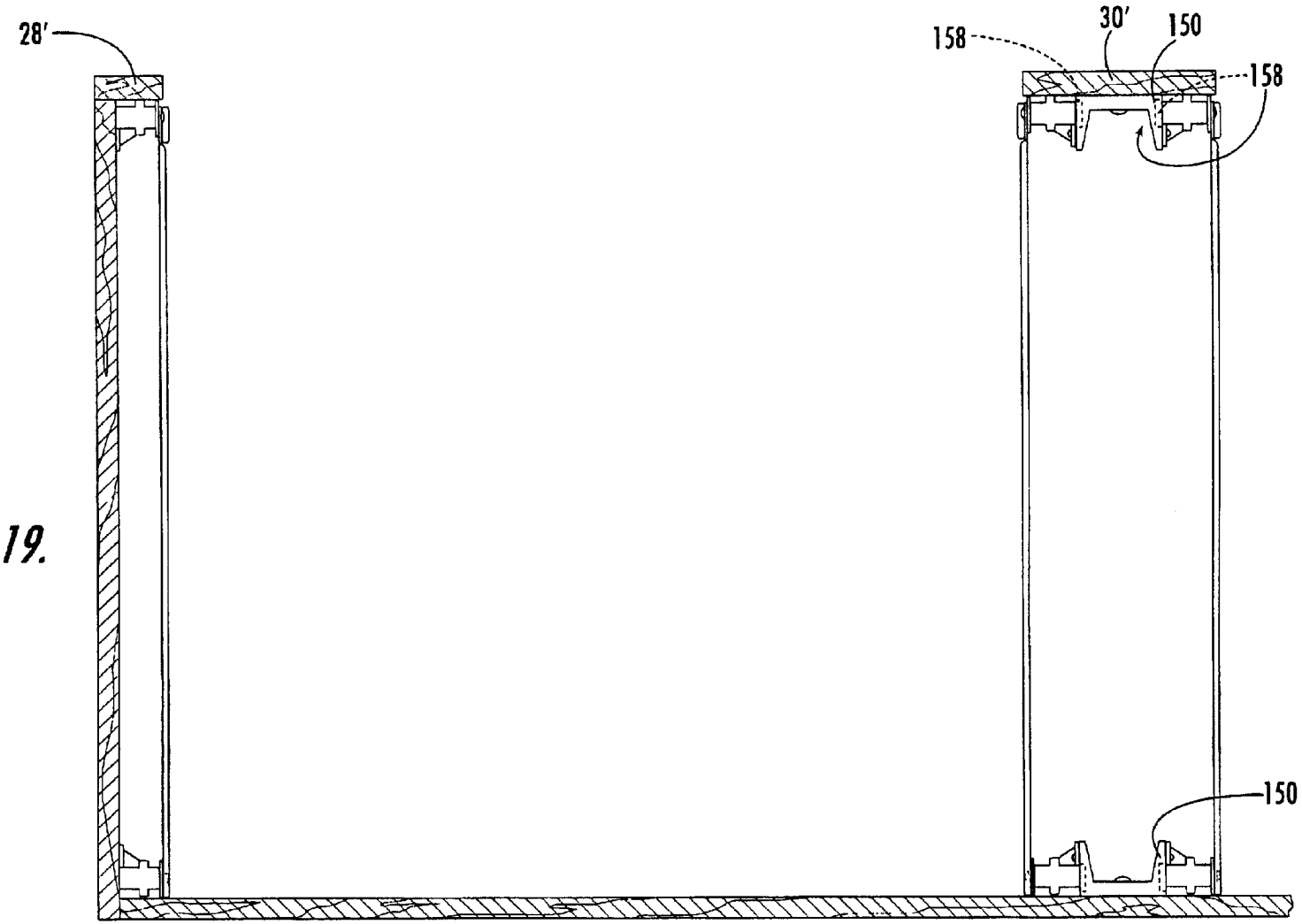
FIG. 19 is a top section view of a cabinet in which the connector of FIG. 16 is mounted.

Referring now to FIG. 15, a screw, designated broadly at 142, is illustrated therein. The screw 142 includes a head 143 and threaded shank 144 of conventional configuration. However, a patch 145 of friction-imparting coating is located on a portion of the shank 144. It has been noted that, in some instances, the screw 112 employed to attach the mounting dowel 100 to the slide member 38*a* has a tendency to "spin out" from the aperture 107 as the tray 36*a* is used, thereby loosening the connection between the mounting dowel 100 and the slide member 38*a*. The inclusion of the friction-imparting patch 145 can reduce or eliminate this tendency. An exemplary material for the patch is nylon. Application of the patch can be any method known to those skilled in this art for the application of the material employed, including spraying, roller or brush application, insert molding, or the like.

Referring now to FIGS. 16–19, another embodiment of a connector for mounting members, designated broadly at 150, is illustrated therein. The connector 150 is generally U-shaped like the connectors 90, 94 and includes a base 152 that abuts a center member 30' of a front wall 28', and further includes a pair of side walls 154*a*, 154*b*. Each side wall includes an oblong aperture 156. An oblong nut 158 has a pair of wings 160 and a central boss 162. The boss 162 has a diameter that is slightly less than the height of the oblong aperture 156. An aperture 164 passes through the boss 162 and receives a screw (not shown) that mounts the front and rear inner mounting members 70*a*', 70*b*', 80*a*', 80*b*'. The oblong shape of the aperture 156 allows the nut 158, and therefore the mounting members 70*a*', 70*b*', 80*a*', 80*b*' to be adjusted forwardly or rearwardly as desired for mounting of the slide members.

The embodiments described above can provide numerous benefits. The rectangular cross-sectional shape of the dowels 100 and 130 can facilitate attachment to the slide members 38*a*, 38*b* and can help to stabilize the mounting of the slide members. The presence of the hook portion 110 assists in maintaining the slide members in place, in particular as the hook portion interacts with the engagement ribs 57*a* and their stepped surfaces 57*b*. The configuration of the mounting members enables a single component to be manufactured rather than requiring "left-hand" and "right-hand" pieces and "front" and "back" pieces, and the mounting members can be of a length to satisfy the needs of most cabinets. The components used to mount the trays 36*a*, 36*b* can be installed in new cabinets or easily retrofitted into older cabinets, and can be employed with cabinets of different widths and front styles. Finally, the height of the trays within the cabinet can easily be adjusted without the need for tools.

Those skilled in this art will also recognize that the mounting members, dowels and the like can be used in other environments. For example, they may be included in shelves or display racks.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. As such, all such modifications are intended to be included within the scope of this invention. The scope of the invention is to be defined by the following claims.

That which is claimed is:

1. A cabinet adapted to receive a drawer, said cabinet comprising:

an enclosure comprising an upright rear wall and opposing upright side walls fixed at rear portions thereof to opposite ends of the rear wall;

a pair of front elongate mounting members mounted generally upright at front portions of the side walls, each of the front mounting members having a mounting surface with a plurality of non-circular mounting apertures facing the other of the front mounting members;

a pair of rear elongate mounting members mounted upright at rear portions of the side walls, each of the rear mounting members having a mounting surface with a plurality of non-circular mounting apertures facing the other of the rear mounting members;

wherein each of the front mounting members and rear mounting members includes a mounting tab that extends generally parallel to the mounting surface and overlies a portion of a respective enclosure side wall;

a pair of slide members, each slide member extending between a respective rear mounting member and a respective front mounting member; and two pairs of detachable mounting dowels, with one mounting dowel of each pair fixed to and connecting a rear end portion of a slide member to a respective rear mounting member, and with the other mounting dowel of each pair fixed to and connecting a front end portion of the slide member to a respective front mounting member, each of the mounting dowels having a body that is generally square in cross-section and that is sized and configured to be received in one of the plurality of apertures in a respective front or rear mounting member, such that each slide member is generally horizontally disposed, and such that each slide member of the pair of slide members is mounted at approximately the same height as the other slide member of the pair.

2. The cabinet defined in claim 1, wherein the dowel body cross-section is generally rectangular.

3. The cabinet defined in claim 1, wherein the dowel body cross-section is generally square.

4. The cabinet defined in claim 1, further comprising an upright front wall opposing the rear wall and fixed to respective front portions of the side walls to form front enclosure corners, the front wall including an access opening, and wherein the front mounting members are mounted in the front enclosure corners.

5. The cabinet defined in claim 4, wherein the enclosure includes a central member that extends generally vertically across the access opening, and wherein a pair of front inner mounting members, each having a mounting surface with a plurality of generally rectangular apertures, are mounted to the central member, with the apertures of each front inner mounting member facing the apertures of a respective front mounting member.

6. The cabinet defined in claim 5, further comprising a pair of rear inner mounting members fixed to a generally central portion of the rear wall, each of the rear mounting members including a mounting surface with a plurality of generally rectangular apertures, with the apertures of each rear inner mounting member facing the apertures of a respective rear mounting member.

7. The cabinet defined in claim 5, further comprising a connector mounted to the central member having a pair of mounting flanges that are generally parallel to the side walls, the front inner members being mounted directly to the connector.

8. The cabinet defined in claim 6, further comprising a pair of inner slide members, each of the inner slide members mounted to and extending between a respective front inner mounting member and a rear inner mounting member.

9. The cabinet defined in claim 4, wherein each of the front mounting members includes a cutaway area adjacent the front corner in which the front mounting member is mounted.

10. The cabinet defined in claim 1, further comprising a tray slidably mounted on the slide members.

11. The cabinet defined in claim 1, wherein the mounting dowel includes a hook portion that extends upwardly from the dowel body and that is captured within the aperture in which the dowel is received.

12. The cabinet defined in claim 11, wherein the mounting dowel body includes a tapered portion below the hook portion.

13. The cabinet defined in claim 1, wherein the apertures in the front and rear mounting members are separated from one other by between about 0.75 and 2.0 inches.

14. The cabinet defined in claim 1, wherein the front and rear mounting members are formed of a polymeric material.

15. A cabinet adapted to receive a drawer, said cabinet comprising:

an enclosure comprising an upright rear wall and opposing upright side walls fixed at rear portions thereof to opposite ends of the rear wall;

a pair of front elongate mounting members mounted generally upright at front portions of the side walls, each of the front mounting members having a mounting surface with a plurality of mounting apertures facing the other of the front mounting members;

a pair of rear elongate mounting members mounted upright at rear portions of the side walls, each of the rear mounting members having a mounting surface with a plurality of mounting apertures facing the other of the rear mounting members;

wherein each of the front mounting members and rear mounting members includes a mounting tab that extends generally parallel to the mounting surface and overlies a portion of a respective enclosure side wall;

a pair of slide members, each slide member extending between a respective rear mounting member and a respective front mounting member; and two pairs of detachable mounting dowels, with one mounting dowel of each pair fixed to and connecting a rear end portion of a slide member to a respective rear mounting member, and with the other mounting dowel of each pair fixed to and connecting a front end portion of the slide member to a respective front mounting member, each of the mounting dowels having a body that is sized and configured to be received in one of the plurality of apertures in a respective front or rear mounting member, such that each slide member is generally horizontally disposed, and such that each slide member of the pair of slide members is mounted at approximately the same height as the other slide member of the pair, and a hook portion that extends upwardly from the dowel body and that is captured within the aperture in which the dowel is received.

16. The cabinet defined in claim 15, wherein the dowel body cross-section is generally rectangular.

17. The cabinet defined in claim 15, further comprising an upright front wall opposing the rear wall and fixed to respective front portions of the side walls to form front enclosure corners, the front wall including an access opening, and wherein the front mounting members are mounted in the front enclosure corners.

18. The cabinet defined in claim 17, wherein the enclosure includes a central member that extends generally vertically across the access opening, and wherein a pair of front inner mounting members, each having a mounting surface with a plurality of generally rectangular apertures, are mounted to the central member, with the apertures of each front inner mounting member facing the apertures of a respective front mounting member.

19. The cabinet defined in claim 18, further comprising a pair of rear inner mounting members fixed to a generally central portion of the rear wall, each of the rear mounting members including a mounting surface with a plurality of generally rectangular apertures, with the apertures of each rear inner mounting member facing the apertures of a respective rear mounting member.

20. The cabinet defined in claim 18, further comprising a connector mounted to the central member having a pair of mounting flanges that are generally parallel to the side walls, the front inner members being mounted directly to the connector.

21. The cabinet defined in claim 20, further comprising a pair of inner slide members, each of the inner slide members mounted to and extending between a respective front inner mounting member and a rear inner mounting member.

22. The cabinet defined in claim 17, wherein each of the front mounting members includes a cutaway area adjacent the front corner in which the front mounting member is mounted.

23. The cabinet defined in claim 15, further comprising a tray slidably mounted on the slide members.

24. The cabinet defined in claim 15, wherein the mounting dowel body includes a tapered portion below the hook portion.

25. The cabinet defined in claim 15, wherein the apertures in the front and rear mounting members are separated from one other by between about 0.75 and 2.0 inches.

26. The cabinet defined in claim 15, wherein the front and rear mounting members are formed of a polymeric material.

27. The cabinet defined in claim 15, wherein the front and rear mounting members are substantially identical in configuration.

28. A cabinet adapted to receive a drawer, said cabinet comprising:

an enclosure comprising an upright rear wall and opposing upright side walls fixed at rear portions thereof to opposite ends of the rear wall, an upright front wall opposing the rear wall and fixed to respective front portions of the side walls to form front enclosure corners, the front wall including an access opening, and a central member that extends generally vertically across the access opening;

a front connector mounted to the central member having a pair of mounting flanges that are generally parallel to the side walls;

a rear connector mounted to a central portion of the rear wall having a pair of mounting flanges that are generally parallel to the side walls;

a front elongate mounting member mounted generally upright in one of the front enclosure corners, the front mounting member having a mounting surface with a plurality of non-circular mounting apertures that face the front connector;

a rear elongate mounting member mounted upright at a rear portion of one of the side walls, the rear mounting member having a mounting surface with a plurality of non-circular mounting apertures that face the rear connector;

an outer slide member extending between the rear mounting member and the respective front mounting member;

a front inner mounting member having a mounting surface with a plurality of generally rectangular apertures mounted to the central member, the front inner mounting member being mounted to the front connector with the apertures facing the apertures of the front mounting member;

a rear inner mounting member including a mounting surface with a plurality of generally rectangular apertures, the rear inner mounting member being mounted to the rear connector with the apertures of each rear inner mounting member facing the apertures of the rear mounting member;

an inner slide member extending between the rear inner mounting member and the front inner mounting member; and a pair of outer mounting dowels, with one mounting dowel of the pair connecting a rear end portion of the outer slide member to the rear mounting member, and with the other mounting dowel of the pair connecting a front end portion of the outer slide member to the front mounting member, each of the mounting dowels having a body that is sized and configured to be received in one of the plurality of apertures in a respective front or rear mounting member, such that the outer slide member is generally horizontally disposed; and a pair of inner mounting dowels, with one mounting dowel of the pair connecting a rear end portion of the inner slide member to the rear inner mounting member, and with the other mounting dowel of each pair connecting a front end portion of the inner slide member to the front inner mounting member, each of the mounting dowels having a body that is sized and configured to be received in one of the plurality of apertures in a respective front or rear inner mounting member, such that each inner slide member is generally horizontally disposed.

29. The cabinet defined in claim 28, wherein the dowel body cross-section is generally rectangular.

30. The cabinet defined in claim 28, wherein the dowel body cross-section is generally square.

31. The cabinet defined in claim 28, wherein each of the front elongate mounting members includes a cutaway area adjacent the front corner in which the front elongate mounting member is mounted.

32. The cabinet defined in claim 28, further comprising a tray slidably mounted on the slide members.

33. The cabinet defined in claim 28, wherein the mounting dowel includes a hook portion that extends upwardly from the dowel body and that is captured within the aperture in which the dowel is received.

34. The cabinet defined in claim 33, wherein the mounting dowel body includes a tapered portion below the hook portion.

35. The cabinet defined in claim 28, wherein the apertures in the front and rear elongate mounting members are separated from one other by between about 0.75 and 2.0 inches.

36. The cabinet defined in claim 28, wherein the front and rear elongate mounting members are formed of a polymeric material.

37. A cabinet adapted to receive a drawer, said cabinet comprising:

an enclosure comprising an upright rear wall and opposing upright side walls fixed at rear portions thereof to opposite ends of the rear wall;

a pair of front elongate mounting members mounted generally upright at front portions of the side walls, each of the front mounting members having a mounting surface with a plurality of non-circular mounting apertures facing the other of the front mounting members;

a pair of rear elongate mounting members mounted upright at rear portions of the side walls, each of the rear mounting members having a mounting surface with a plurality of non-circular mounting apertures facing the other of the rear mounting members;

a pair of slide members, each slide member extending between a respective rear mounting member and a respective front mourning member; and two pairs of mounting dowels, with one mounting dowel of each pair connecting a rear end portion of a slide member to a respective rear mounting member, and with the other mounting dowel of each pair connecting a front end portion of the slide member to a respective front mounting member, each of the mounting dowels having a body that is sized and configured to be received in one of the plurality of apertures in a respective front or rear mounting member, such that each slide member is generally horizontally disposed, and such that each slide member of the pair of slide members is mounted at approximately the same height as the other slide member of the pair;

wherein each of the front mounting members and rear mounting members includes a mounting tab that extends generally parallel to the mounting surface and overlies a portion of a respective enclosure side wall.

38. The cabinet defined in claim 37, wherein the dowel body cross-section is generally rectangular.

39. The cabinet defined in claim 37, wherein the dowel body cross-section is generally square.

40. The cabinet defined in claim 37, further comprising an upright front wall opposing the rear wall and fixed to respective front portions of the side walls to form front enclosure corners, the front wall including an access opening, and wherein the front mounting members are mounted in the front enclosure corners.

41. The cabinet defined in claim 40, wherein the enclosure includes a central member that extends generally vertically across the access opening, and wherein a pair of front inner mounting members, each having a mounting surface with a plurality of generally rectangular apertures, are mounted to the central member, with the apertures of each front inner mounting member facing the apertures of a respective front mounting member.

42. The cabinet defined in claim 40, wherein each of the front mounting members includes a cutaway area adjacent the front corner in which the front mounting member is mounted.

43. The cabinet defined in claim 37, further comprising a tray slidably mounted on the slide members.

44. The cabinet defined in claim 37, wherein the mounting dowel includes a hook portion that extends upwardly from the dowel body and that is captured within the aperture in which the dowel is received.

45. The cabinet defined in claim 44, wherein the mounting dowel body includes a tapered portion below the hook portion.

46. The cabinet defined in claim 37, wherein the apertures in the front and rear mounting members are separated from one other by between about 0.75 and 2.0 inches.

47. The cabinet defined in claim 37, wherein the front and rear mounting members are formed of a polymeric material.

48. A frameless cabinet adapted to receive a drawer, said cabinet comprising:

an enclosure comprising an upright rear wall and opposing upright side walls fixed at rear portions thereof to opposite ends of the rear wall, the enclosure further including at least one door attached to one of the side walls via a hinge mounted to an inner surface of the side wall and an inner surface of the door;

a pair of front elongate mounting members mounted generally upright at front portions of the side walls spaced apart from front edges thereof, each of the front mounting members having a mounting surface with a plurality of non-circular mounting apertures facing the other of the front mounting members;

a pair of rear elongate mounting members mounted upright at rear portions of the side walls, each of the rear mounting members having a mounting surface with a plurality of non-circular mounting apertures facing the other of the rear mounting members;

wherein each of the front mounting members and rear mounting members includes a mounting tab that extends generally parallel to the mounting surface and overlies a portion of a respective enclosure side wall;

a pair of slide members, each slide member extending between a respective rear mounting member and a respective front mounting member; and two pairs of mounting dowels, with one mounting dowel of each pair connecting a rear end portion of a slide member to a respective rear mounting member, and with the other mounting dowel of each pair connecting a front end portion of the slide member to a respective front mounting member, each of the mounting dowels having a body that is sized and configured to be received in one of the plurality of apertures in a respective front or rear mounting member, such that each slide member is generally horizontally disposed, and such that each slide member of the pair of slide members is mounted at approximately the same height as the other slide member of the pair.

49. The cabinet defined in claim 48, wherein the side wall inner surfaces include a plurality of preformed holes located to accept a fastener, and wherein each of the front mounting members is mounted to a respective side wall via a fasteners inserted into one of the plurality of preformed holes.

50. The cabinet defined in claim 48, wherein the dowel body cross-section is generally rectangular.

51. The cabinet defined in claim 48, wherein the dowel body cross-section is generally square.

52. The cabinet defined in claim 48, wherein each of the front mounting members includes a cutaway area adjacent the front corner in which the front mounting member is mounted.

53. The cabinet defined in claim 48, further comprising a tray slidably mounted on the slide members.

54. The cabinet defined in claim 48, wherein the mounting dowel includes a hook portion that extends upwardly from the dowel body and that is captured within the aperture in which the dowel is received.

55. The cabinet defined in claim 54, wherein the mounting dowel body includes a tapered portion below the hook portion.

56. The cabinet defined in claim 48, wherein the apertures in the front and rear mounting members are separated from one other by between about 0.75 and 2.0 inches.

57. The cabinet defined in claim 48, wherein the front and rear mounting members are formed of a polymeric material.

* * * * *